United States Patent [19]

Olson et al.

[11] Patent Number: 4,754,712

[45] Date of Patent: Jul. 5, 1988

[54] ADJUSTABLE RACK OF SHELVES

[75] Inventors: Ralph Olson, Lombard; Irwin Kulbersh, Skokie, both of Ill.

[73] Assignee: AMCO Corporation, Chicago, Ill.

[21] Appl. No.: 863,954

[22] Filed: May 16, 1986

Related U.S. Application Data

[63] Continuation-in-part of Ser. No. 835,434, Mar. 3, 1986, abandoned, which is a continuation-in-part of Ser. No. 611,493, May 17, 1984, abandoned.

[51] Int. Cl.[4] ..... A47B 9/00

[52] U.S. Cl. ..... 108/111; 108/144

[58] Field of Search ..... 108/111, 110, 144, 107; 211/186, 187; 248/407, 408, 409; 403/298, 292

[56] References Cited

U.S. PATENT DOCUMENTS

| | | | |
|---|---|---|---|
| 2,693,358 | 11/1954 | Dawson, Jr. | 248/407 X |
| 3,349,531 | 10/1967 | Watson | 403/298 X |
| 3,424,111 | 1/1969 | Maslow | 108/144 |
| 3,523,508 | 8/1970 | Maslow | 108/144 |
| 3,545,123 | 12/1970 | Muller | 403/298 X |
| 3,604,369 | 9/1971 | Maslow | 108/144 |
| 3,675,598 | 7/1972 | Kesilman et al. | 108/144 |
| 3,757,705 | 9/1973 | Maslow | 108/144 |
| 3,869,218 | 3/1975 | Stoeber et al. | 108/111 X |
| 3,874,511 | 4/1975 | Maslow | 108/144 |
| 3,896,743 | 7/1975 | Pariente | 108/111 |
| 3,932,048 | 1/1976 | Du Pont | 403/298 X |
| 3,972,638 | 8/1976 | Vivoli | 403/298 X |
| 4,079,678 | 3/1978 | Champagne | 108/144 X |
| 4,094,417 | 6/1978 | Cairnes et al. | 108/111 X |
| 4,128,064 | 12/1978 | Chung et al. | 108/111 |
| 4,158,336 | 6/1979 | Brescia et al. | 108/111 |
| 4,257,333 | 3/1981 | Pollack | 108/111 X |
| 4,318,352 | 3/1982 | Friedman et al. | 108/111 |
| 4,527,490 | 7/1985 | Tipton et al. | 108/111 |
| 4,582,001 | 4/1986 | Leikarts | 108/144 X |
| 4,589,351 | 5/1986 | Love | 108/111 |
| 4,593,826 | 6/1986 | Bustos | 108/144 X |
| 4,627,543 | 12/1986 | Nicely | 108/144 |

*Primary Examiner*—Kenneth J. Dorner
*Assistant Examiner*—José V. Chen
*Attorney, Agent, or Firm*—Laff, Whitesel, Conte & Saret

[57] ABSTRACT

A rack system of adjustable shelves has a simple and economical shelf assembly mechanism. A shelf is attached to its supporting vertical posts by placing each of the posts through an individually associated corner shelf socket. The shelf is kept in position by a plastic keeper which can be moved up and down the post to the desired height of the shelving. The keeper has a generally truncated pyramidal shape and at least one internal projection which fits into a dimple, recess, or notch formed in the post at the desired shelf height. The keeper has vertical slots that enables it to be squeezed together and to tightly wedge into the shelf socket and support the shelf on the corner post. The system can be adapted to both square and circular posts.

17 Claims, 4 Drawing Sheets

FIG.1
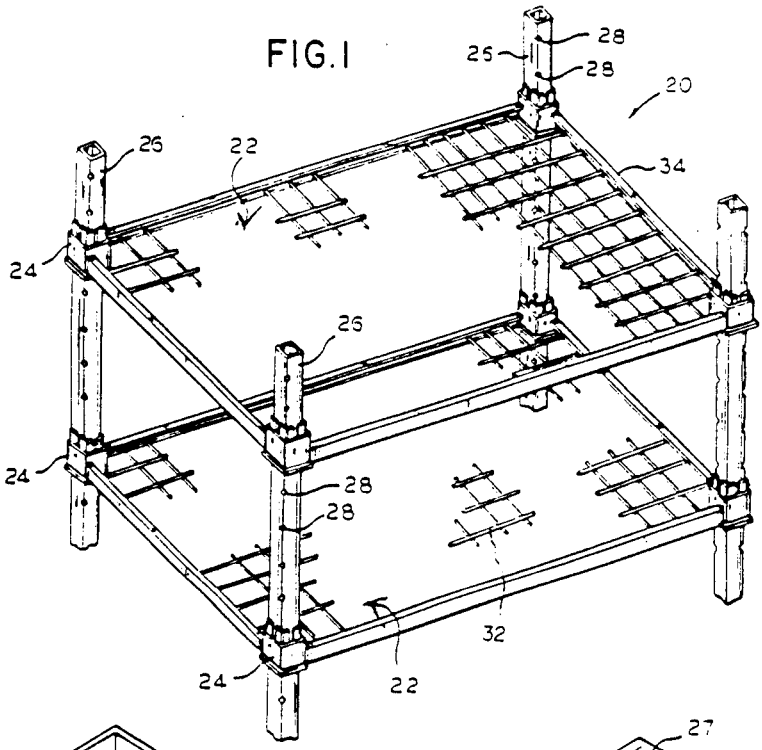
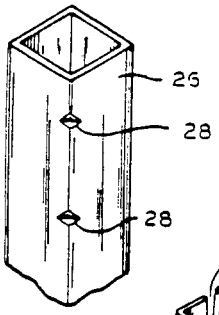
FIG.2
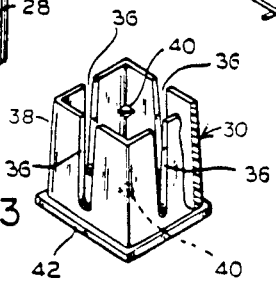
FIG.3
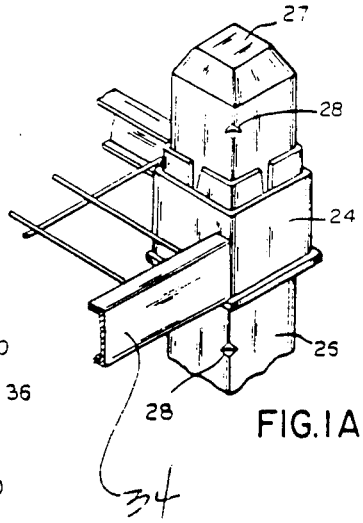
FIG.1A

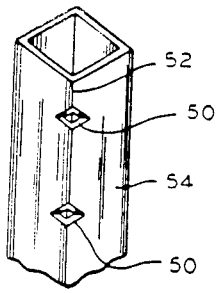
FIG.5
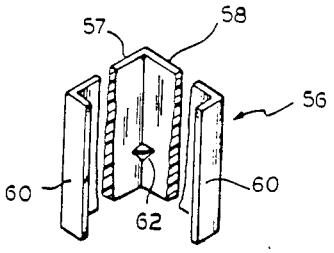
FIG.6
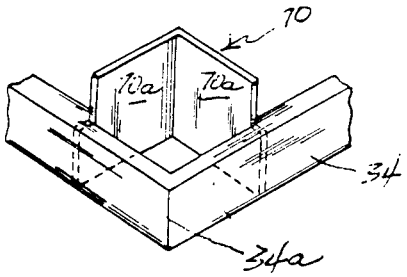
FIG.7
FIG.4
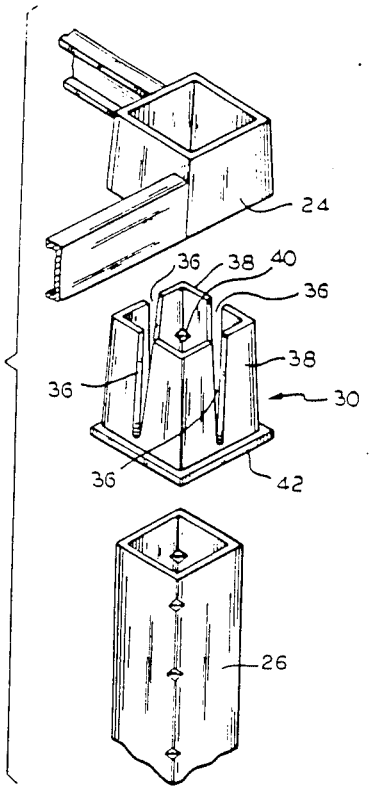
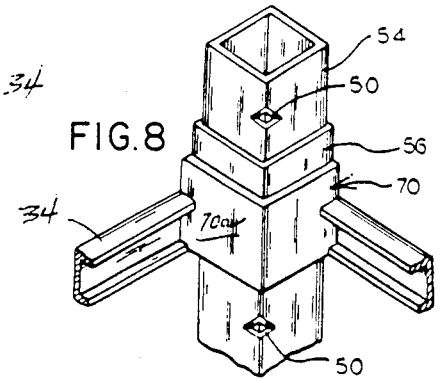
FIG.8

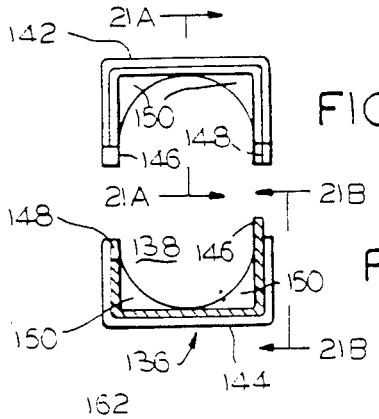
FIG.20A
FIG.20B
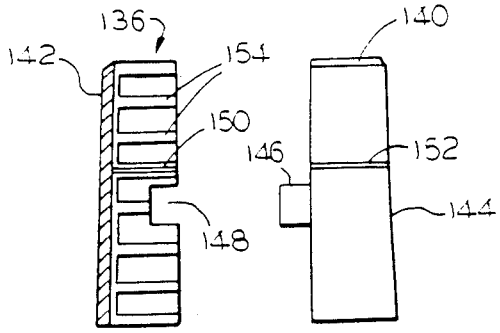
FIG.21A FIG.21B
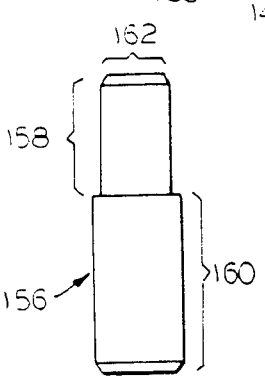
FIG.22
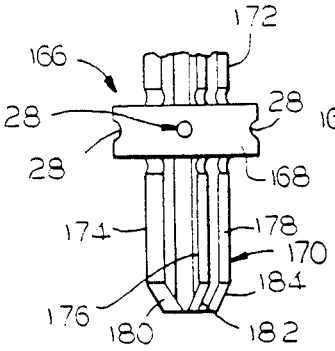
FIG.23
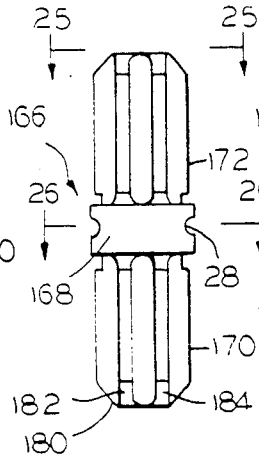
FIG.24
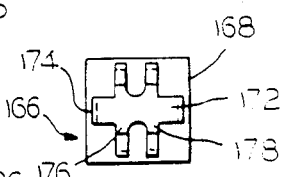
FIG.25
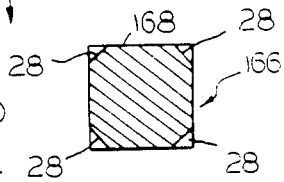
FIG.26
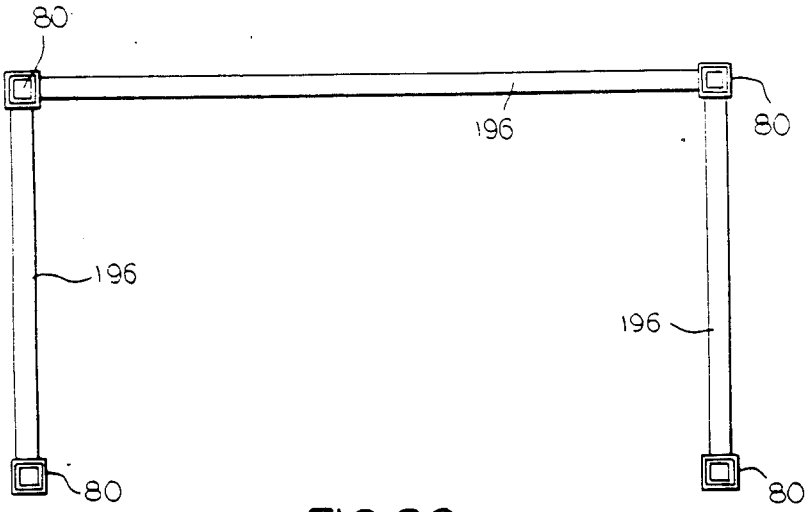
FIG.28
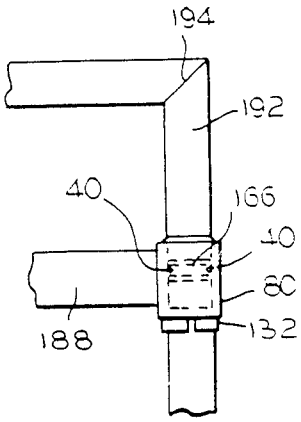
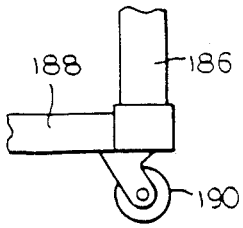
FIG.27
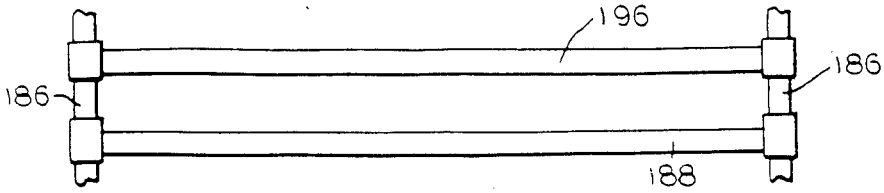
FIG.29

ADJUSTABLE RACK OF SHELVES

This is a continuation-in-part of Ser. No. 06/835,434 filed Mar. 3, 1986, now abandoned which was, in turn, a continuation-in-part of 06/611 493 filed May 17, 1984, now abandoned.

This invention relates to racks of adjustable shelves and, more particularly, to improved shelving comprised of flat shelves with corner sockets that attach to vertical corner posts which are held in place by keepers that are easily adjustable to vary shelf heights.

Adjustable shelving systems are known in the art. Such systems have many advantages in that they enable, among other things, a maximization of the use of costly storage space. Such shelving is also easily adapted to accommodate and support varying product sizes, thus enabling great flexibility as product designs and storage requirements change.

An adjustable shelving system has been described in U.S. Pat. Nos. 3,424,111 and 3,523,508. This system teaches the use of shelf members, circular corner shelf supports, circular corner posts with graduated recesses and two-piece, semi-circular post supports for holding the shelf support and corner post in place. More particularly, the shelf supports are preferably metal and are comprised of two separate pieces which are wrapped around the corner post and snapped into place. Thus, in order to adjust the height of the shelf, the shelf supports must be detached from the shelf and moved. If one section of the shelf support is lost or broken, the shelving is useless until another shelf support is obtained.

Accordingly, an object of this invention is to provide new and improved racks of adjustable shelves. A more particular object is to provide a simpler and more economical shelf support mechanism which may be operated quickly and easily to relocate a shelf. In fact, one object is to provide a one-piece keeper with an operational and economic advantage not found in conventional adjustable shelving.

Another object of the invention is to provide such keepers that are quickly and inexpensively made on conventional machine tools or by molding equipment.

Yet another object is to provide generally rectangular, and preferably, square corner posts for greater stability and with a graduated plurality of periodically recurring notches along their vertical length for enabling a simple and easy adjustment of shelf height.

In keeping with one aspect of this invention, an adjustable rack of shelves comprises at least one shelf attached to at least one vertical post by placing the posts through corner sockets of the shelf. Between the shelf socket and the post, a metal or plastic, and preferably, nylon keeper keeps the shelf in a desired height position on the post. The posts have a graduated plurality of periodically recurring notches along the length of the post. The keeper has a truncated pyramidal shape and at least one internal projection which fits into a notch on the shelf post, at a desired height, to hold the shelf in place. The keeper can be easily moved up and down the post to any desired shelving height.

The above mentioned and other features of this invention and the manner of obtaining them will become more apparent and the invention itself will be best understood by reference to the following descriptions of embodiments of the invention taken in conjunction with the accompanying drawings, in which:

FIG. 1 is a perspective view of an adjustable rack of shelves which is a first embodiment of the shelf and post combination incorporating the principles of the invention;

FIG 1A is a perspective view showing, in greater detail, a corner portion of the adjustable rack of shelves shown in FIG. 1;

FIG 2 is a perspective view of a shelf post with notches spaced at regular intervals, such as 1-inch to 1½ inches;

FIG. 3 is a perspective view of a first embodiment keeper, also shown in FIG. 1A;

FIG. 4 is an exploded view of the shelf socket, being placed into position over the keeper;

FIG. 5 is a perspective view of a second embodiment of the invention showing vertically spaced, somewhat diamond shaped notches piercing corners of the shelf posts;

FIG. 6 is a perspective view of the keeper for the second embodiment of the invention;

FIG. 7 is an outside perspective view of the corner shelf socket for the second embodiment of the invention;

FIG. 8 is an inside perspective view of a corner detail showing the assembled second embodiment of the invention;

FIG. 20A is an end view of one half of the split keeper, rotated clockwise 90°, as viewed along line 20A—20A in FIG. 19;

FIG. 20B is a partial transverse section of the other identical mating half of the keeper as viewed along line 20B—20B in FIG. 19;

FIG. 21A is an elevational view in section taken along line 21A—21A of the embodiment of FIG. 20A;

FIG. 21B is a side elevational view of the non-sectioned one-half of the keeper, both halves being identical and mating when brought into mating relationalas viewed along line 21B—21B in FIG. 20B;

FIG. 22 shows, in side elevation, an adapter plug for holding a top generally planar member, not shown, in position relative to the open end of a hollow support;

FIG. 23 is a partial corner view of the bottom half of a connection for joining hollow posts of the invention rack;

FIG. 24 is a side elevation of the entire connector of FIG. 23;

FIG. 25 is an end view taken along line 25—25 of FIG. 24;

FIG. 26 is a cross section taken along line 26—26 of FIG. 24;

FIG. 27 is a partial view of the right hand side of a rolling cart which illustrates, by way of example, how the connector of FIGS. 23–26 may be used to add a handle to the cart;

FIG. 28 is a plan view of a fence which may be placed around certain sides of the open area of a shelf; and FIG. 29 is an elevation view of a shelf having the fence of FIG. 28 associated therewith.

Figure 9:
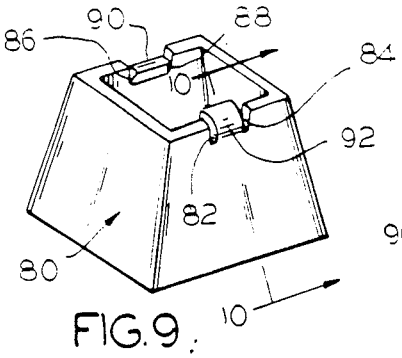
FIG. 9 is a perspective view of an embodiment using a socket having shoulder means formed by tongues sheared from within the margins of said socket.

As shown in FIG. 1, a rack of shelves 20, constructed in accordance with the teachings of this invention, comprises at least one flat shelf 22 having four corner sockets 24, corner posts 26 with a graduated plurality of recurring dimples, recesses, or notches 28 and keepers 30 for maintaining the truncated shelf in position on each post 26. To expedite assembly, a pyramidal cap 27 (FIG. 1A) may be used on the top of the post 26. This cap seals the top and readily guides the parts which fit over the post into place, without catching. On the bottom of each post is a threaded metal or plastic insert (not shown) which seals the bottom and provides a thread for adjusting a leveling bolt to fit for non-level floors. Shelf 22 may be constructed of a mesh of metal wires or rods 32 welded together or otherwise secured in any suitable manner to a shelf frame 34.

As shown in greater detail in FIG. 1A, the corner sockets 24 are welded to the frame 34, for receiving the vertical posts. Each of these sockets has an internal opening with a somewhat truncated pyramidal shape. The bottom end of the socket is tapered outwardly with respect to the top end in order to guide the post 26 into position and to form an effective wedge holding action in cooperation with the keeper 30.

As shown in FIG. 2, the post having a generally rectangular cross section is provided with a plurality of notches 28 spaced at regular intervals of about one to one and one-half inches along the length of at least one edge of the posts 26. These notches receive and accommodate detents 40 located on the interior contour of the keeper.

The construction details of one exemplary keeper appear in FIG. 3. As there shown, the keeper comprises a one-piece, truncated, generally pyramid-shaped sleeve which can be placed over the shelf post 26. The top edge of keeper 30 has vertical slots 36 in each side wall 38 so that the side walls of the keeper can be more readily squeezed, thus causing a detent 40 located on at least one interior corner near the uppermost edge of the keeper to be more securely wedged into the dimples or notches 28 of the shelf post 26. The vertically extending slots also enable the cross section at the top of the keeper passageway to be slightly smaller than the cross section of the post. This way, the keeper more tightly embraces the post. An outwardly protruding base 42 forms the lowermost edge of the keeper 30 to support the shelf socket. The lowermost edge preferably may be used when a perfect fit is more or less insured. The lowermost edge may preferably be eliminated if there is serious danger that a corner socket may fit down low enough to break the edge away from the keeper. The keeper is constructed of materials which are durable enough to provide a strong and reliable locking mechanism and yet is yieldable so that the detent can be firmly engaged in a notch of the post. A suitable material of construction for the keeper is nylon.

As shown in FIG. 4, when the shelf socket 24 is placed over the keeper 30, the side walls 38 of the keeper 30 are squeezed together, forming an effective wedge and locking mechanism for supporting the shelf on the post. The protruding base 42 of the keeper 30 fits under and helps support the shelf to hold it firmly in place on the post.

An alternative embodiment of the invention is shown in FIG. 5. There, the dimples, recesses, or notch 50 comprise a deeper diamond shaped notch cut into and piercing the post wall. Again, these notches are spaced at regular intervals of about one to one and a half inches along one exterior corner edge 52 of the shelf post 54. These notches accommodate a detent 62 of the keeper generally shown in FIG. 6 to provide a means for engaging and supporting the shelf on the posts.

The construction details of this alternative embodiment of the keeper are shown in FIG. 6. The keeper 56 comprises a one-piece device having two perpendicular and tapering walls 57 and 58, each with an attached retaining flange 60. The flanges partially wrap around the post and thus can be more readily retained on the post 54 while the shelf system is being assembled. The two perpendicular walls 57 and 58 are thicker at the lowermost edge of the keeper 60 to provide a tapering, somewhat truncated pyramidal effect so that the keeper fits tightly within the shelf socket when it is positioned over the keeper. A detent 62 is located in the interior corner at the junction of the two perpendicular, tapered walls 57, 58. The detent fits in a notch 50 on the post 54. When the walls of the keeper are squeezed by the walls of the shelf socket responsive to the weight of the shelf, the detent is firmly locked in place. The keeper is constructed of materials which are both strong enough to support the weight of the shelf and yet are yieldable enough to enable the walls of the keeper to squeeze and securely engage the shelf post and shelf socket. Again, nylon is such a material.

FIG. 7 shows a preferred alternative embodiment of a shelf socket 70 which is used with the post 54 with the and keeper 56 of FIG. 6. The frame 34, in this embodiment, is a closed circuit with the ends of the side members forming the corner or two sides of the socket 70 by being welded at the corner 34*a*. The other two sides 70*a* of the socket 70 a generally truncated pyramidal interior to socket 70. The shelf post 54 with the keeper 56 attached thereto is placed through the shelf socket 70, as shown in FIG. 8. The weight of the shelf squeezes the keeper 56 against post 54 and the detent 60 firmly engages a selected notch 50, thus holding the shelf firmly in place. The tapered shape of the keeper 56 enables it to be firmly wedged into the shelf socket.

Another embodiment may use a post of FIG. 2 with dimples 28 which do not pierce the post in connection with keeper 56 of FIG. 6.

As shown in FIGS. 1A and 8, shelf sockets 24 and 70, respectively, are securely attached to frame or c-channel 34, by means of welding or any suitable method, along the edge of the frame 34 that is adjacent to and abuts the sockets. The frame lies flat against sockets 24 and 70 to provide a continuous surface for attachment of the sockets. This results in increased strength of the shelf and sockets as a unit.

This invention also makes it possible to economically add any number of supplemental units with only two posts (a savings of two posts per shelf unit). This is accomplished by the use of two inexpensive clips, per shelf. This can be done with the shelving extending in line or perpendicular to the last unit.

This inventive adjustable shelving rack is not limited to use in a stationary installation. It has the flexibility to be made into a mobile unit by inserting round or square stemmed casters not shown, in lieu of threaded leveling inserts at the post bottom.

The construction of the shelf is not limited in length, width or height. The shelves include metal or plastic, wire mesh, solid or perforated panels.

Various considerations enter into the selection of a socket and a keeper design. For example, if the shelves are not loaded or if they have a very light load, a vibration may cause the sockets of the shelves to creep up the plastic keepers. The result is a general loosening of the shelf assembly. The problem is usually most severe with a top shelf which is not loaded and which is, perhaps, the most important shelf from the viewpoint of anchoring the ends of the long lever arm formed by the vertical posts. Vibration may result from many different causes, such as a mobile shelving unit rolling across a floor.

Another consideration is the use of the shelves. If they support something for human consumption, such as food, drink, or medicine, the vertical grooves 36 and ledge 42 (FIG. 3) form places where dirt, particles, or the like, may lodge. This collection of debris could interfere with proper sanitation procedures.

Another problem is that, since the ledge 42 limits downward movement of the shelf socket, the sockets may not fit as snuggly as they could. Therefore, there may be some looseness.

Accordingly there should be alternative designs for the keeper so that the user may select particular socket and keeper combination which is designed to fit his particular needs.

In FIG. 9, the socket has the same overall truncated, generally pyramid-shape (shown in exaggerated form for illustrative purposes) which was described above in connection with the socket 24. There are two pairs of opposed small slotted sections at 82–88 which extend inwardly and downwardly below the upper end of socket 80 and, therefore, might collect debris. However, the smallness and limited depth of these cuts 82–88 tend to reduce the amount of debris pile up to very little or nothing. Thus, for most applications, this design is acceptable.

Figure 10:
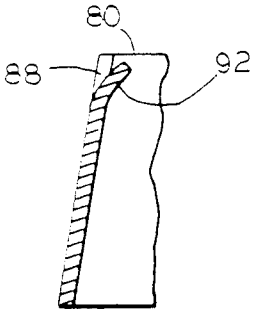
FIG. 10 is a cross section taken along the line 10—10 of FIG. 9.

As best shown in FIG. 10, these shears or cuts 82–88 form between them a pair of opposed tongues 90, 92 which are bent inwardly toward the center of the pyramid and form shoulder means. Of course, a tongue may also be formed on each of the four sides of the socket 80.

In FIG. 11, the socket 96 is, again, a truncated, generally pyramidal shape with a dimple such as 98, 100 formed on each side. The cross section of FIG. 12 shows that the dimple extends inwardly to form a projection 102 on the inside of the socket.

Figure 13:
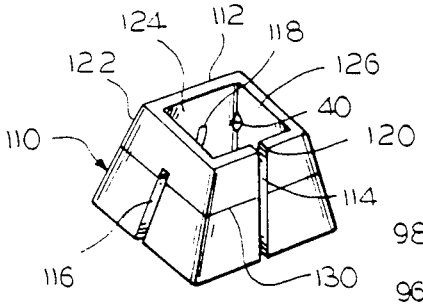
FIG. 13 is a perspective view of another embodiment of a plastic keeper for positioning between the post and the socket.

FIG. 13 is a perspective view of a plastic keeper 110 with a solid top edge 112, except for a relatively small slot 114 which enables the keeper to spring apart and enlarge its internal cross section as the detents 40 on each internal edge pass into and out of the notches 28 on the post 26. The top edge 112 is continuous, except for slot 114, and thereby prevents debris from building up in slots 116–120 which open downwardly through the bottom edges of the sides 122–126 respectively. These slots also help the keeper to flex as the socket presses downwardly. A score line or ridge 130 is an indicia means formed on the outside of the keeper 110, at the level of the detents 40, to help the user to find the notch 28 when the keeper is put into place, and may be used with other post indicia means set forth hereinafter.

Figure 11:
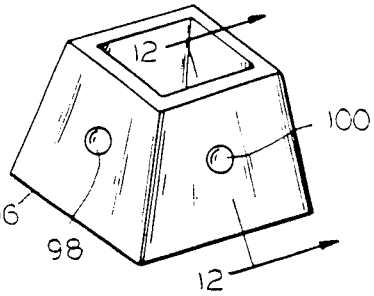
FIG. 11 is a perspective view of another embodiment of the invention using a socket with inwardly directed protuberances in the form of dimples.
Figure 12:
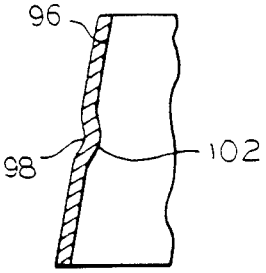
FIG. 12 is a cross section taken along line 12—12 of FIG. 11.
Figure 14:
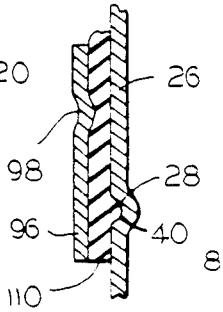
FIG. 14 is a partial cross section showing the cooperation between the walls of a socket, keeper and post using the embodiments of the socket of FIG. 11 and the keeper of FIG. 13

FIG. 14 shows a cross section of the socket 96 of FIGS. 11, 12, the keeper 110 of FIG. 13, and the post of FIG. 2. The keeper 110 is placed on the post 26 with the detent 40 in a notch 28 of the post. The socket 96 of FIG. 11 is slipped over the keeper 110 (FIG. 13), and it has been found that in due course, the weight of the shelf causes the plastic of keeper 110 to conform itself to and to assume the internal shape of the socket under the dimple 98. As the socket seats itself and the dimple 98 forces its impression into the plastic of keeper 110, a mechanical lock forms which keeps the socket from creeping up the keeper if vibrations occur. The lock against downward motion occurs by the wedging action of the tapered side walls of the keeper 96.

Figure 15:
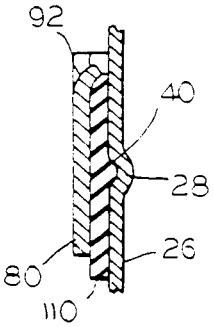
FIG. 15 is a partial cross section showing the cooperation between the walls of a socket, keeper, and post using the embodiments of the socket of FIG. 9 and the keeper of FIG. 13.

In FIG. 15, the operation is the same as in FIG. 14, except that the inwardly directed tongue 92 bites into the plastic due to the weight on the shelf and the cold flow of the plastic.

Figure 16:
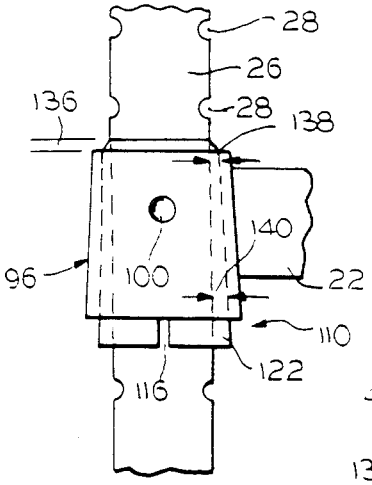
FIG. 16 is a partial side elevation of a assembly of a post, a socket (of FIG. 11) with shelf, and the keeper of FIG. 13.

The completed assembly is shown in FIG. 16 where the keeper 110 projects a distance 136 above the socket 96, such as 1/16-inch. The keeper 110 preferably is molded and has a wall thickness which flares from a relatively narrow top 138 to a relatively wide bottom 122 to form a truncated pyramid. The socket 96 slides down the keeper 110 as far as the flare of the socket permits. There, the dimple bites into the keeper. The hoop strength of the rigid flare of the pyramid limits and prevents further downward socket travel. The embedment and deformation of the plastic keeper 110 by the dimples 98, 100 or the tongues 90, 92 prevent upward travel.

Also as shown in FIG. 16, the socket 96 extends below shelf 22. This arrangement wherein a portion of the socket 96 extends downwardly below shelf 22 improves the rigidity of the entire shelf assembly by reducing the torque effect transmitted by the loaded shelves to the psosts 26 and thus stabilizes the posts. Prior art shelves often required reinforcing gussets attached to the shelf 22 and sockets 96 to help reduce the torque caused by the loaded shelves 22. Such gussets are not necessary with use of socket 96 extending below shelf 22.

Figure 16A:
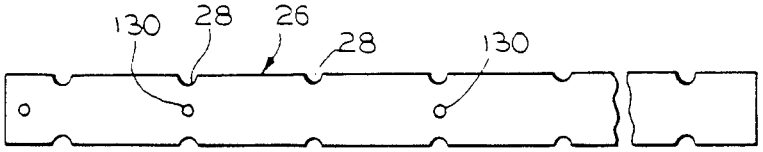
FIG. 16A is a side elevation of a shelf support corner post with indicia means identifying the location of certain notches.

As shown in FIG. 16A, the corner posts 26 have number of notches 28 distributed along the length thereof. Thus, it is very easy to place the keepers for a shelf at different heights, causing misalignment of the shelf. Depending upon a number of factors, it may be very awkward trying to readjust the height of a keeper on one corner post after a shelf is in position and the misalignment is first discovered. To help align the keepers, indicia means, such as a dimple 130*a* is formed adjacent every fourth (for example) notch 28. Matching indicia means on the keeper, such as ridge 130, can be used by observing dimple 130*a* through either slots 114 or 116. This way the keeper may be placed in the second notch 28 above the third dimple 130*a* on a corner post. Of course, other means may be used to identify the notches 28. For example, a series of numbers may be embossed on the post. However, the dimples or an embossed line or symbol are among the least expensive and least obvious marking means, and experience shows that such indicia means are completely satisfactory for alignment purposes.

Figure 17:
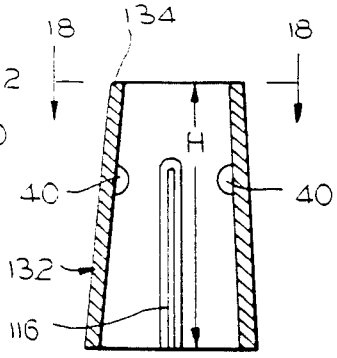
FIG. 17 is a cross-sectional view, in elevation of another improved keeper having easier installation and means for precluding possible cold flow problems.
Figure 18:
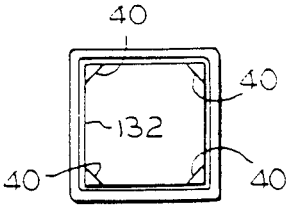
FIG. 18 is a top end view taken along line 18—18 of FIG. 17.

FIG. 17 illustrates a further sophistication in the keeper design. More particularly the keeper 132 has a greater height H and has a chamfer 134 along its top edge. The chamfer guides and directs the socket as it slides into place over the keeper. The height H of the keeper is, perhaps, 50% longer than the height which is required by the design height of the corner socket. Thus, over long years, there could be a tendency for the plastic of the keeper to elongate or cold flow and thereby thin the tapered wall section under the weight of the shelf. This longer keeper obviously will continue to support the socket over a greater vertical dimension. It may not be readily apparent that there is a vertical displacement of plastic, however, a ridge tends to form in the plastic of the keeper at the bottom edge of the socket. Thus, the increased height "H" serves the dual function of giving the socket a greater travel to accept wider tolerances, between socket and post, by its tapered walls, and to conform itself to the shape of the socket by building up a supporting ledge at the bottom of the socket.

Figure 19:
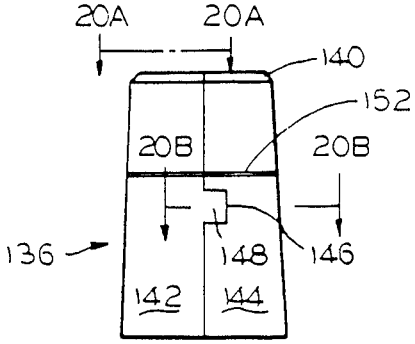
FIG. 19 is a side elevation of an embodiment of the keeper which is for use with corner posts having a circular cross section.

FIGS. 19–21 illustrate still another embodiment of plastic keepers which may be used with the invention. One of the more popular shelf systems described in the above cited patents uses round corner posts having circular cross section with annular grooves formed periodically along their length. Each of these round corner posts has an annular groove at a location corresponding to the notches 28 in FIG. 16. These systems have plastic keepers which fit around the posts and lock into a selected one of the grooves.

If the present shelves are to be used on existing systems having the round corner posts, an adapter keeper is required so that the present generally square sockets may be locked in a vertical position on the round posts.

The two piece identical mating plastic adapter keeper 136 (FIGS. 19–21) forms a circular center hole 138 and a truncated pyramidal external surface which fits into and supports the corner socket. The top of the adapter keeper 136 also has a chamfer 140 which helps guide and direct the socket into place as it fits over the keeper. The keeper has two identical half shells 142, 144 which are keyed together oppositely and held in vertical alignment by disposed tangentially lateral tabs 146 and notches 148 adapted to complimentarily accept tab 146.

Inside each half shell, there is a semi-circular ridge 150 which fits into the annular groove of the round post to lock the keeper in a predetermined position relative to the post. The outside truncated pyramidal surface of the keeper 136 has a shallow equatorial groove 152 which serves as a visual index of the location of semi-circular ridge 150 and which assists the installer who assembles the shelf system. To save plastic and to avoid shrink marks, the interior of each half shell 142, 144 has a number of horizontally disposed semi-circular ribs 154 which are sized to provide a complimentary fit against the ungrooved surface of the round corner posts not shown.

Thus to use the adapter keeper 136, the half-shells 142, 144 are placed on opposite sides of a round corner post, not shown, with the indicia means or index groove 152 aligned with a desired post groove (e.g. similar in location to notches 28 in FIG. 16). Together semi circular ridges 150 fit into such a post groove. It should be noted that complimentary tabs 146 and notches 148 are simultaneously engaged when the identical half shells 142, 144 are brought into juxtaposed relation relative to the round post, not shown. Suitable engageable means can be provided between tab 146 and notch 146 by taking advantage of the resilient and lubricious nature of the plastic material forming the keeper. Then, a corner socket of the shelf is lowered over the adapter keeper. The weight of the shelf and the encirclement of the keeper by the socket hold the half shells in position.

Sometimes the inventive shelf system is relatively low so that a top should be placed on it. Exemplary of such a system is a rolling cart having a butcher block type top. In order to mount the top on the rack of shelves forming a rolling cart, an adapter 156 (FIG. 22) may be placed on the top of the corner post. This adapter 156 comprises a top part 158, preferably having a circular cross section, which which fits snugly into a hole drilled in a corner of the butcher block top. The bottom 160 is a plug which fits into the top of the corner post. The adapter 156 can be made of stainless steel, for example.

A connector 166 is shown in FIGS. 23–126. For example, the corner posts may be made in a number of different lengths such as: 2-feet, 3-feet, 4-feet, and 6-feet. If it is necessary to have a rack which is seven feet tall, a 3-foot and a 4-foot post may be joined. For an eight foot tall rack, a 2-foot and a 6-foot post may be joined. The connector of FIG. 23–26 provides for making these connections. Also, as drawn in FIG 27, the connector may be used to add accessory items, such as a handle to an assembly.

In greater detail, the adapter connector comprises a centrally disposed member 168 with outside dimensions conforming exactly to the outside dimensions of all corner posts and having four notches 28 formed at the corners thereon to receive keeper detents 40. Oppositely extending from the central member are coupling or stud members 170,172 extending co-axially therefrom. The outside dimensions of the connector members conform exactly to the inside dimensions of the corner post, with a fairly snug fit. The connector or stud members have a somewhat H-shaped cross section (FIG. 25 formed by vertical ribs 174, 176, 178 which provide a high degree of rigidity by spaced contact between the connector member and the interior of the corner post. The central bar of the H-shaped cross section is defined by rib 174. Chamfers 180, 182, and 184 on the end of the ribs assist in an insertion of the connector means into the corner post.

FIG. 27 illustrates an exemplary use of the invention to form a rolling cart. More particularly, four relatively short corner posts 186, and any suitable number of shelves 188 are assembled to make a cart. Caster 190 is affixed at each lower corner of the cart. The connector 166 is inserted into the top of the corner post 186.

Then a keeper 132 is slipped over the coupler, with detents 40 fitting into notches 28 formed in the central member 168 (see FIG. 23). A corner socket 80 on the uppermost shelf 188 fits over the keeper to prevent the assembly from separating. A handle 192 is made from the same stock that is used to make the corner post. The handle 192 is formed from one piece and bent into a U-shape or comprises three parts which are welded together as one to form a generally U-shaped member. The end of the handle 192 is slipped over the upper end of the connecting member 166.

There are times when it is necessary or desirable for a shelf to have a fence, also known as a three sided frame, around it. For example, on the rolling cart of FIG. 27, items setting on the shelf 188 could fall off. Another example of a time when a fence would be of advantage is when something with a circular cross section, such as a keg of beer, is laying on the shelf and might roll off, if not restrained.

For this, a number (usually three) of rails 196 (FIG. 28) are welded to corner sockets to form a fence, here a U-shaped fence. The fence is mounted on the corner posts in the same manner that the shelves are mounted. Depending upon the needs, the fences may also extend around all four or any suitable number or sides.

The many advantages of this adjustable rack of shelves should now be self-apparent. First, the parts are easily and inexpensively made on general purpose machine tools and a tube mill, extrusion or molding equipment. Second, the keepers are a one piece construction which can be economically made quickly and efficiently; parts will not be lost; they are strong, durable and reliable to withstand the weight of a loaded shelf and repeated use. Of course, there are still other advantages which will be apparent to those skilled in the art.

Those who are skilled in the art will readily perceive how to modify the system. Therefore, the appended claims are to be construed to cover all equivalent structures which fall within the true scope and spirit of the invention.

The claimed invention is:

1. A rack system for supporting at least one shelf in a generally horizontal disposition by a plurality of vertically disposed hollow post members, each member having a plurality of axially spaced recesses, the shelf including at least two generally rectangular socket members, each having a substantially truncated pyramidal configuration, a tapered keeper having at least one internal detent, said keeper being adapted to fit over the post and said socket being adapted to fit over the keeper when the latter is on the post, the detent fitting into a recess of the post members when the keeper is on the post, each socket member being adapted to squeeze the associated keeper into a generally fixed relation with a post member to form a substantially rigid rack structure, whereby said rack is assembled by slipping one of said keepers over each post and placing said sockets over the keepers, a three-sided fence member having a rectangular generally U-shape, and means comprising a plurality of said sockets formed on said fence member for removably securing said fence to said post members, said fence member comprises an elongated member formed into said rectangular generally U-shape with said sockets located at corners of said U-shaped shape.

2. A rack system for supporting at least one shelf in a generally horizontal disposition by a plurality of vertically disposed hollow post members, each member having a plurality of axially spaced recesses, the shelf including at least two generally rectangular socket members, each of said socket members having a substantially truncated pyramidal configuration, a tapered keeper having at least one internal detent, said keeper being adapted to fit over the post and said socket being adapted to fit over the keeper when the latter is on the post, the detent fitting into a recess of the post members when the keeper is on the post, each of said socket members being adapted to squeeze the associated keeper into a generally fixed relation with a post member to form a substantially rigid rack structure, whereby said rack is assembled by slipping one of said keepers over each post and placing said sockets over the keepers, a three-sided fence member joined into a rectangular shape with one side of said rectangle open, and means for removably securing said fence member to said post members, wherein said means for removably securing said fence member to said post members comprises at least two of said socket members and associated keepers.

3. The rack of claim 2 wherein the keeper has side walls which rise from an outwardly protruding base, said base projecting laterally from the bottom of said side walls to help support the bottom of said socket.

4. The rack of claim 2 wherein each of said keepers comprises a sleeve having two adjacent tapered sides forming half of said truncated pyramidal shape, said detent means being positioned inside said sleeve at the junction of said two tapered adjacent sides.

5. The rack of claim 4 and retainer flanges extending from non-adjacent edges of said tapered sides to at least partially surround said post far enough to hold said sleeve when on said post.

6. The rack of claim 2 wherein said keeper has four tapered and resilient side walls with at least one vertical slot extending from a bottom edge of at least one of said side walls upwardly to a point which is lower than the top edge of said side walls, a passageway through said keeper having a cross section which is slightly smaller than the cross section of said post whereby said resilient side walls are deflected outwardly as said detent slides along said post and across said recesses.

7. The rack of claim 6 wherein said socket has at least one projection extending inwardly to engage said keeper, said keeper being made from a distortable material which is capable of being deformed to a shape which accommodates the post and the projection, whereby said projection and accomodated shape together form a mechanical lock to said keeper by virtue of said shaping.

8. The rack of claim 6 wherein said post and said keeper each have indicia means which are mutually disposed to facilitate a serial engagement of the keeper's internal detent with the post's various recesses.

9. The rack of claim 2 and coupling means for joining the hollow ends of said hollow post members, said coupling means including a central flange-like member and at least one integral stud portion extending outwardly therefrom, said stud portion being complementary to interior configurations of the hollow end of said post members to engage said post at a plurality of points about an interior thereof, and said flange providing a seat for receiving and supporting an end of said post surrounding said hollow end.

10. The rack set forth in claim 9 wherein each of said stud portions include a plurality of axially extending rib means engaging a plurality of axially disposed areas on an interior of said post.

11. The rack set forth in claim 10 wherein each of said stud portions is generally H-shaped in cross-sectional configuration with the free end of each leg of the H-shaped portion engaging the inner-wall of said post.

12. The rack set forth in claim 11 wherein a laterally extending axially disposed rib is provided on each side of said H-shaped portion as an extension of a central bar of the H-shape for engagement with an intermediate interior said wall of the post to thereby stabilize and locate said stud portion.

13. The rack of claim 2 wherein said keeper is made of plastic and has tapered side walls extending uniformly from one end to the other, the length of said keeper being at least 50% greater than the length of the socket with which it is cooperatively associated.

14. The rack set forth in claim 2 wherein said keeper has plastic walls with an axial length substantially in excess of the length of its companion socket, said socket and keeper being constructed to cause a shoulder to form in said walls of said keeper and thereby restrain movement of said socket relative thereto.

15. The rack system of claim 2 wherein said handle member is U-shaped.

16. The rack system of claim 2 wherein a portion of said socket member extends below said shelf.

17. A rack system for supporting at least one shelf in a generally horizontal disposition by a plurality of vertically disposed hollow post members, each member having a plurality of axially spaced recesses, the shelf including at least two generally rectangular socket members, each of said socket members having a substantially truncated pyramidal configuration, a tapered keeper having at least one internal detent, said keeper being adapted to fit over the post and said socket being adapted to fit over the keeper when the latter is on the post, the detent fitting into a recess of the post members when the keeper is on the post, each socket member being adapted to squeeze the associated keeper into a generally fixed relation with a post member to form a substantially rigid rack structure, whereby said rack is assembled by slipping one of said keepers over each post and placing said sockets over the keepers, a three-sided fence member having a rectangular generally U-shape, and means comprising a plurality of said sockets formed on said fence member for removably securing said fence to said post members, and at least one handle member removably coupled to a top of two of said post members.

* * * * *